US009840354B2

(12) United States Patent
Graux et al.

(10) Patent No.: US 9,840,354 B2
(45) Date of Patent: Dec. 12, 2017

(54) STOPPER FOR A CONTAINER NECK

(71) Applicant: Tetra Laval Holdings & Finance S.A., Pully (CH)

(72) Inventors: Stéphane Graux, Liergues (FR); David Jouve, La Mulatiere (FR)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 617 days.

(21) Appl. No.: 14/382,180

(22) PCT Filed: Feb. 25, 2013

(86) PCT No.: PCT/EP2013/053717
§ 371 (c)(1),
(2) Date: Aug. 29, 2014

(87) PCT Pub. No.: WO2013/131773
PCT Pub. Date: Sep. 12, 2013

(65) Prior Publication Data
US 2015/0298870 A1 Oct. 22, 2015

(30) Foreign Application Priority Data
Mar. 5, 2012 (FR) ..... 12 51987

(51) Int. Cl.
*B65D 41/34* (2006.01)

(52) U.S. Cl.
CPC ..... *B65D 41/3428* (2013.01)

(58) Field of Classification Search
CPC ..... B65D 39/08; B65D 41/0421; B65D 41/0428; B65D 41/3428
USPC ..... 215/341, 343, 344, 316, 357, 329, 355, 215/356; 220/298, 300–302
See application file for complete search history.

(56) References Cited

U.S. PATENT DOCUMENTS 4,493,427 A * 1/1985 Wolkonsky ..... B65D 23/06 215/230
7,527,161 B2 * 5/2009 Rodriguez ..... B65D 41/3419 215/252

FOREIGN PATENT DOCUMENTS

| | | |
|---|---|---|
| DE | 10 2007 005594 | 8/2008 |
| EP | 0515260 | 11/1992 |
| JP | 2001 146244 | 5/2001 |
| WO | WO 03/016161 | 2/2003 |

(Continued)

OTHER PUBLICATIONS

International Search Report in PCT/EP2013/053717, dated Jul. 11, 2013 (3 pages).

*Primary Examiner* — Anthony Stashick
*Assistant Examiner* — Raven Collins
(74) *Attorney, Agent, or Firm* — Finnegan, Henderson, Farabow, Garrett & Dunner, L.L.P.

(57) ABSTRACT

A stopper is disclosed. The stopper includes a tubular skirt, designed to surround a container neck and including, on either side of a weakening line, a removable skirt portion, inwardly provided with means for removable fastening to the neck, and a non-removable skirt portion, inwardly provided with a retaining strip permanently around the container neck. The strip comprises an annular main body whereof a first end is turned opposite the removable skirt portion and integral with the non-removable skirt portion, while a second end is provided to axially abut against a bulge of the container neck and to be radially inserted between the bulge and the skirt.

10 Claims, 8 Drawing Sheets

(56) References Cited

FOREIGN PATENT DOCUMENTS

| | | |
|---|---|---|
| WO | WO 2005/067588 | 7/2005 |
| WO | WO 2006/060098 | 6/2006 |

* cited by examiner

STOPPER FOR A CONTAINER NECK

CROSS-REFERENCE TO RELATED APPLICATIONS

This is a U.S. National Phase of PCT/EP2013/053717, filed Feb. 25, 2013, which claims the benefit of priority to French Patent Application No. 1251987, filed Mar. 5, 2012, which is incorporated herein by reference.

The present invention relates to a stopper for a container neck.

The invention generally relates to stoppers comprising a generally tubular skirt, which surrounds the neck of a container and whereof a lower portion, when the neck of the container is considered to extend vertically with its mouth oriented upward, is designed to remain permanently around the container neck after the first time the bottle is opened, while the rest of the skirt, in other words the top portion thereof, is provided to be removable from the neck, for example by screwing-unscrewing, while initially being connected to the lower non-removable portion of the skirt by a peripheral weakening line, which can be broken the first time the stopper is opened. This weakening line, which for example includes breakable bridges, serves to indicate to the user that the bottle has been opened for the first time.

The invention more particularly relates to stoppers whereof the non-removable lower skirt portion is retained around the container neck by cooperation between a peripheral strip, protruding inside the skirt, and a bulge associated with the container neck: the first time the stopper is opened, this retaining strip abuts axially, by the free upper end of its main body, against the aforementioned bulge of the container neck. An example of such a stopper is disclosed in WO-A-03/016161 on which the preamble of appended claim 1 is based.

This being recalled, a general issue related to the invention pertains to the possibility, after placing the stopper around the container neck, of cleaning at least part of that neck, which is trimmed by the skirt of the stopper. This cleaning is useful to rid the outer face of the container neck of as many impurities as possible, generally consisting of residue from the liquid food product or other product with which the bottle has been filled before being closed. Without cleaning or in the event of insufficient cleaning, this residue risks causing biological contamination of the neck of the container, typically by mold or similar problems.

Currently, the use of a cleaning liquid to rinse the outside of a container neck, when the latter is already equipped with a stopper of the aforementioned type, encounters real difficulties in terms of implementation. In fact, even when the cleaning liquid is pressurized, that liquid circulates very poorly from the inside of the retaining strip, the main body of which takes up most of the space between the base of the stopper and the neck of the container, up to the inner face of the upper part of the skirt where the means for removable fastening to the container neck are situated. Nearly all of this liquid is even blocked toward the top in cases where the retaining strip has a peripheral tongue at the upper free end of its main body that is radially inserted between the bulge of the container neck and the skirt of the stopper, on the one hand for correct positioning of the retaining strip during placement of the stopper on the container neck and, on the other hand, proper operation of the retaining strip the first time the stopper is opened. Even in the case of aforesaid WO-A-03/016161, in which the retaining strip is interrupted along its periphery, the cleaning liquid remains at the lower end of the retaining strip, without actually being forced to go up around the container neck. A similar configuration is disclosed in WO-A-2005/067588, in DE-A-10 2007 005594 and in WO-A-2006/060098.

The aim of the present invention is to propose a stopper of the aforementioned type which, while having a reliable and effective retaining strip, allows effective cleaning of the container neck after the stopper is placed thereon.

To that end, the invention relates to a stopper for a container neck, as defined in claim 1.

One of the ideas at the base of the invention is to form effective circulation pathways in the retaining strip for the cleaning liquid for cleaning a container neck, said pathways connecting the inner face of said strip to its outer face, without altering the function of said strip aiming to mechanically maintain the non-removable skirt portion around the container neck the first time it is opened. To that end, the invention provides that the inner face of the main body of the retaining strip delimits non-trough recesses that each extend axially between the opposite axial ends of the main body, in other words between the upper and lower ends thereof when one considers that the axis of the skirt of the stopper extends vertically with the removable skirt portion oriented upward: in this way, cleaning fluid, in particular sent pressurized to the base of the stopper placed on the neck, easily supplies the lower end of those recesses and effectively rises in those recesses, up to their high level at which the fluid spreads all around the container neck, just below the bulge thereof associated with the abutment surfaces delimited at the upper end of the main body. The invention also provides that the cleaning fluid, having thus reached the abutment surfaces, easily goes from the inner radial region of the upper end of the main body to the outer face of the retaining strip, using free spaces that, two by two, separate the insertion tongues that are borne protruding by the upper end of the main body of the strip: considering that these tongues somehow jointly form an insertion band, this means that the aforementioned free spaces regularly interrupt that band along the periphery of the strip, to allow the cleaning liquid to pass in large quantities through that band. The cleaning liquid that has thus passed through the aforementioned free spaces is then outside and on the upper portion of the retaining strip, from where that cleaning liquid can then rise in large quantity along the container neck, in particular after having bypassed the aforementioned bulge of the container neck by the outside, to reach the upper raised portions of the neck, associated with the fastening means provided inside the removable skirt portion. In this way, the invention cleverly takes advantage of the need for the upper portion of the main body of the strip to be bulky toward the inside of the skirt to delimit the abutment surfaces therein, so as to form the aforementioned recesses in the thickness of the inner surface of that main body and to size said recesses to channel a large part of the cleaning liquid for cleaning the container neck therein. The invention also cleverly forms the aforementioned insertion band, regularly interrupting it along the periphery thereof, to allow the cleaning liquid to reach the outer side of the upper portion of the retaining strip, where the liquid has space to flow in large quantities, without compromising the positioning and stabilization effects produced by that insertion band. Furthermore, the developments of the retaining strip according to the invention, relative to cleaning of the container neck, can advantageously be optimized relative to mechanical strength and/or manufacturing considerations, in particular for molding of that strip, as outlined hereafter.

Additional advantageous features of the stopper according to the invention are specified in the dependent claims.

The invention will be better understood upon reading the following description, which is provided solely as an example and done in reference to the drawings, in which.

Figure 1:
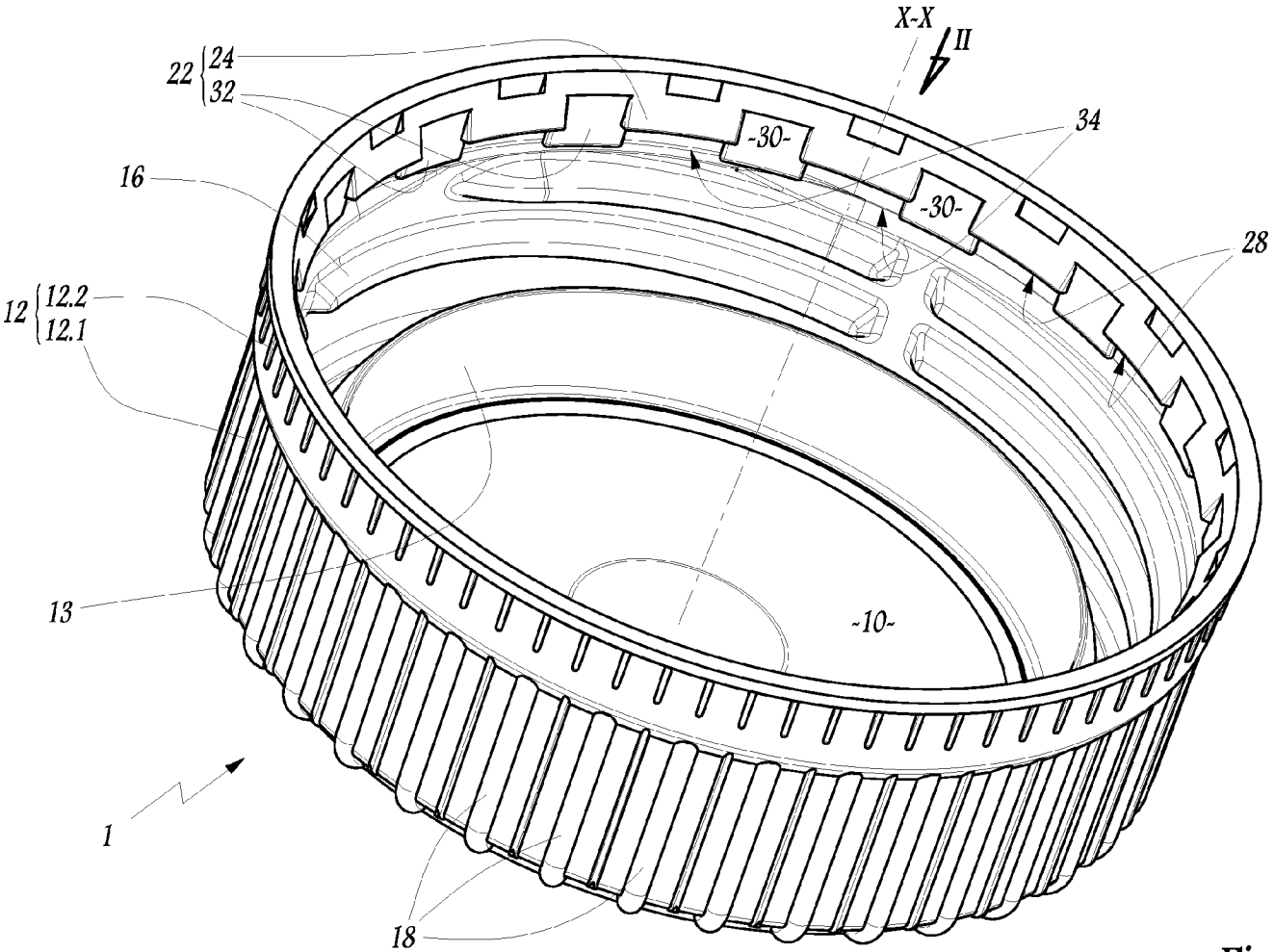
FIG. 1 is a perspective view of a stopper according to the invention.
Figure 2:
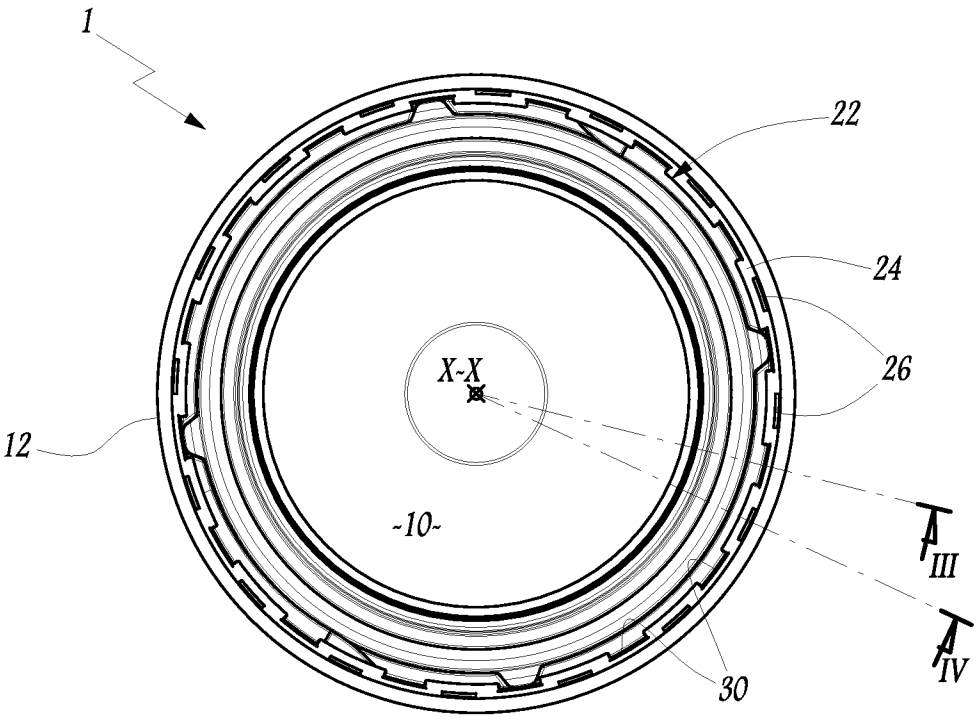
FIG. 2 is an elevation view along arrow II of FIG. 1.

FIGS. 1 to 9 show a stopper 1 adapted to be screwed removably on a container neck 2, the latter part only being shown in FIGS. 5 to 9. In practice, the neck 2 is integral with the rest of the container, in particular when the latter is a glass or plastic bottle, or adapted to be permanently secured on a container wall, at an opening passing through that wall.

The stopper 1 and the neck 2 have generally tubular respective shapes, the central longitudinal axes of which are substantially combined, under shared reference X-X, when the stopper is screwed on the neck, as in FIGS. 5 to 9. For convenience, the rest of the description is oriented considering that the terms "upper" and "top" correspond to a direction substantially parallel to the axis X-X and going from the body of the container toward its neck 2, i.e., a direction oriented upward in FIGS. 3 to 6, 8 and 9, while the terms "lower" and "bottom" correspond to the same orientation in the opposite direction.

The neck 2 includes a generally cylindrical body 3 with a circular base, centered on the axis X-X. At its upper end, this body 3 delimits a mouth 4 at which the liquid contained in the container is designed to be poured. On the outer face of the body 3, the neck 2 is successively provided, from top to bottom, with a spiral thread 5 and a bulge 6, both of which protrude radially outward.

The lower end of the stopper 1 is open, whereas its upper end is closed by a substantially planar bottom wall 10, at the outside periphery of which a tubular skirt 12 extends downward centered on the axis X-X. In the example embodiment considered in the figures, the lower face of the bottom wall 10 is provided both with a protruding tubular lip 13, centered on the axis X-X and arranged inside the outer skirt 12, and a protruding heel 14, running over the outer periphery of the bottom wall. When the stopper 1 is screwed on the neck 2, as in FIGS. 5 to 9, the bottom wall 10 extends above and through the neck, while, on the one hand, the skirt 12 outwardly surrounds the body 3 and, on the other hand, the lip 13 and the heel 14 are respectively sealably pressed against the inner face of that body and on the outer periphery of the mouth 4, to allow the stopper 1 to sealably close the neck 2.

The upper portion of the inner face of the skirt 12 is provided with a thread 16 radially protruding inward and complementary with the outer thread 5 of the neck of the container 2, thereby allowing the stopper 1 to be screwed and unscrewed on the neck. To facilitate holding and rotating of the stopper, the upper part of the outer face of the skirt 12 is provided with protruding ribs 18, which extend lengthwise parallel to the axis X-X and which are distributed substantially regularly along the outer periphery of the skirt, as shown in FIG. 1.

The first time the stopper 1 is opened, the skirt 12 is provided to be separated into two separate portions, i.e., an upper portion 12.1, whereof the upper end is integral with the bottom wall 10, and a lower portion 12.2 initially connected to the upper portion 12.1 by a weakening line 20. This line 20 runs over the entire periphery of the skirt 12, while being globally fitted into a plane perpendicular to the axis X-X, situated axially in the running portion of the skirt 12. The line 20, which is only shown diagrammatically in FIGS. 3 to 6, 8 and 9 by dotted lines, has arrangements not limiting on the present invention, aiming for that line to break the first time the stopper is opened. As an example, this weakening line includes breakable bridges which, before breaking, connect the skirt portions 12.1 and 12.2.

Subject to breaking of the weakening line 20, the skirt portion 12.1 is designed to be freed from the container neck 2 such that the running portion of that removable skirt portion 12.1 is inwardly provided with a thread 16 and outwardly with ribs 18. The non-removable skirt portion 12.2 is designed to remain permanently around the neck of the container 2: to that end, that skirt portion 12.2 is inwardly provided with a retaining strip 22 that is designed to cooperate by contact with the bulge 6 of the container neck 2 the first time the stopper 1 is unscrewed.

Figure 4:
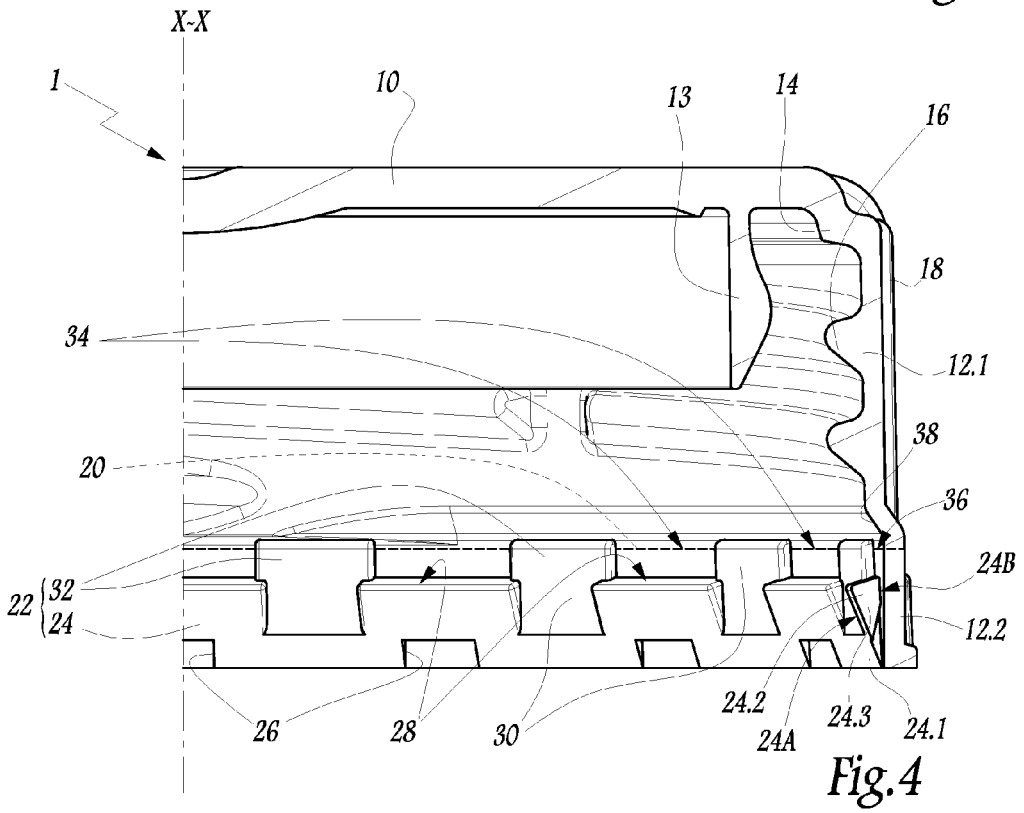

As shown in FIGS. 1 and 4, the retaining strip 22 comprises a main body 24 having a generally annular shape, centered on the axis X-X. This main body 24 is arranged inside the lower skirt portion 12.2 such that its lower axial end 24.1 is turned opposite the upper skirt portion 12.1, while its upper end 24.2 is turned toward said skirt portion 12.1. The main body 24 is jointly connected to the lower skirt portion 12.2 by its lower end 24.1, which, in the example embodiment considered in the figures, advantageously forms a material connection between the lower skirt portion 12.2 and the rest of the main body 24.

In light of the annular shape of the main body 24, the lower end 24.1 of the latter runs over the entire inner periphery of the lower skirt portion 12.2. Advantageously, for reasons that will appear below, the lower end 24.1 of the main body 24 does not run continuously over the outer periphery of the skirt portion 12.2, but is regularly interrupted by through holes 26 that pass all the way through the main body 24 in respective directions transverse to the axis X-X, thereby connecting the inner 24A and outer 24B faces of the main body 24 to each other at the axial level of the lower end 24.1 of said main body.

Figure 3:
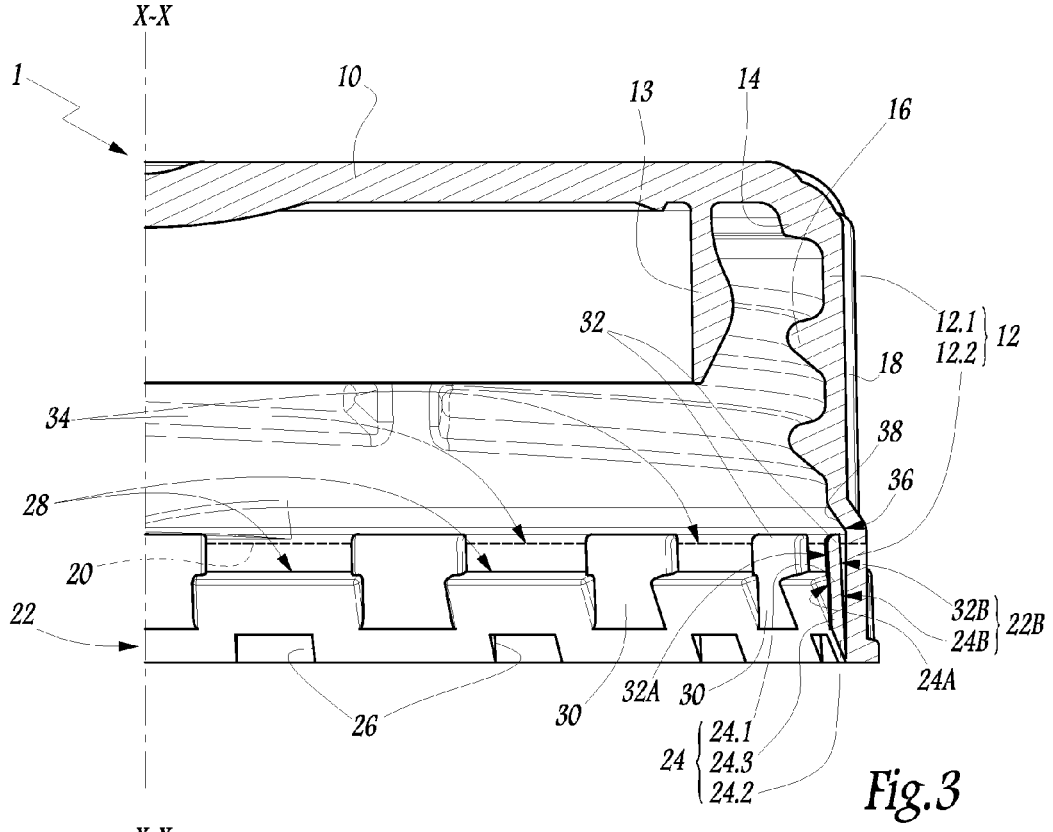
FIGS. 3 and 4 are longitudinal half-sections of the stopper of FIG. 1, respectively along lines III and IV of FIG. 2.

In practice, the through holes 26 are distributed substantially regularly along the periphery of the main body 24. Furthermore, in the example embodiment considered in the figures, these through holes 26 have a substantially rectangular transverse section, as seen in FIGS. 3 and 4, having, however, noted that the shape of this transverse section is not limiting on the invention. Furthermore, the axial dimension of the through holes 26 is not limited to that shown in the figures, in that said through holes may, from the lower end 24.1 of the main body 24, extend upward in a more or less pronounced manner in the running portion 24.3 of the main body 24.

As shown in FIGS. 1, 3 and 4, the upper end 24.2 of the main body 24 has an inner radial portion that does not run continuously along the periphery of the main body, but which includes a series of free surfaces 28 separate from one another, separated in pairs by a recess 30 formed in the inner surface 24A of the main body 24, each of said recesses thus extending axially downward from the axial level of the free surfaces 28. It will be understood that the free surfaces 28 are distributed, along the periphery of the main body 24, alternating with the recesses 30.

In a known manner, each of the free surfaces 28 is designed to be situated axially just below the bulge 6 of the container neck 2 when the stopper 1 is in position on said container neck and closes the latter, as shown in FIGS. 5 to 9: the first time the stopper 1 is unscrewed, each of the free surfaces 28 abuts axially upward against the bulge 6, which retains the lower skirt portion 12.2 around the container neck 2. In practice, as shown in FIGS. 5, 6, 8 and 9, as long as the stopper 1 is not manipulated for the first unscrewing thereof, play remains axially between the free surfaces 28 and the inner face of the bulge 26, the presence of the axial play resulting, inter alia, from dimensional allowances between the stopper 1 and the container neck 2.

Although the interest of the recesses 30 will be explained later, it is already possible to note that the presence of said recesses 30 does not alter the function of mechanically retaining the lower skirt portion 12.2 by the strip 22, in particular inasmuch as the free surfaces 28, ensuring the upward axial abutment of the inner radial portion of the upper end 24.2 of the main body 24 against the bulge 6 of the container neck 2, are distributed, advantageously substantially regularly, all around the axis X-X and jointly form a sufficiently extended axial abutment interface along the periphery of the upper end 24.2 of the main body 24.

Taking the previous considerations into account, it will be noted that the axial reach of the recesses 30 is not limited to that of the embodiment shown in the figures. Indeed, each of the recesses 30 can, from the upper end 24.2 of the main body 24, extend downward in a more or less pronounced manner in the running portion 24.3 of said main body, while obviously accounting for the maximum thickness of available material of the main body 24 in that the recesses 30 are made in the inner face 24A of the main body, without emerging transversely in the outer face 24B of said main body.

Turning now to the outer radial portion of the upper end 24.2 of the main body 24, it will be noted that this end 24.2 bears tongues 32 that each advantageously extend protruding upward from the end 24.2, while advantageously, as in the example embodiment considered in the figures, being integral with the main body 24. The tongues 32, which belong to the retaining strip 22, have the known function of being radially inserted between the bulge 6 of the container neck 2 and the skirt 12 when the stopper 1 is positioned on said container neck and closes the latter, as in FIGS. 5 to 9. In that way, the tongues 32 reliabilize the operation of the abutment surfaces 28 in that, despite the existence of the aforementioned axial play between the surfaces 28 and the lower face of the bulge 6, the tongues 32 guarantee recovery of the aforementioned axial play the first time the stopper is opened, in particular by avoiding poor axial abutment of some of the surfaces 28 against the bulge 6, for example related to excessive radial allowances or an excessive misalignment between the respective axes of the stopper 1 and the container neck 2.

While taking the preceding into account, it will be noted that the invention provides that the insertion tongues 32 do not form a single band running continuously around the axis X-X, but are distributed separately along the outer periphery of the main body 24, while being separated in pairs by a free space 34. In this way, the tongues 32 and the free spaces 34 are distributed alternating along the outer periphery of the upper end 24.2 of the main body 24.

In the embodiment considered in the figures, each of the free spaces 34 extends axially upward from the upper end 24.2 of the main body 24, up to the axial level of the free upper ends of the tongues 32, thereby emerging freely upward.

Also in the embodiment considered in the figures, the tongues 32 occupy respective angular positions around the axis X-X that are the same as those occupied by the recesses 30 described above, whereas, at the same time, the free spaces 34 occupy respective angular positions that are the same as those occupied by the free surfaces 28, which are also advantageously the same as those occupied by the through holes 26. This embodiment of the relative arrangement between the free surfaces 28, the recesses 30, the tongues 32 and the free spaces 34, as well as, if applicable, through holes 26, is of significant interest regarding the performance of the strip 22 on the one hand, by reconciling mechanical strength, for retention of the skirt portion 12.2 around the container neck 2, and the possibility of cleaning the neck as explained in detail below, and, on the other hand, the manufacture of the strip 22, in particular the molding of a plastic material thereof jointly with the rest of the stopper 1. Thus, in the extension of the preceding considerations, the peripheral dimension of the recesses 30 around the axis X-X is advantageously provided to be equal to that of the tongues 32 whereas, at the same time, the peripheral dimension of the free surfaces 28 is provided to be equal to that of the free spaces 34.

Likewise, in particular for reasons related to the manufacture of the strip 22 and as provided in the embodiment considered in the figures, the outer face 32B of each of the tongues 32 extends flush with the outer face 24B of the main body 24, which means that the outer face 22B of the strip 22, which is formed by the outer faces 24B and 32B, is smooth, in that that outer face 22B does not have a surface discontinuity between the main body 24 and the tongues 32 of the strip. Likewise, the inner face 32A of each of the tongues 32 advantageously extends flush with the radial bottom of the recesses 30 such that jointly with the inner face 32A, the latter forms a smooth surface, in particular without discontinuities at the junction between the recesses 30 and the tongues 32.

According to one particularly advantageous optional arrangement, implemented in the embodiment considered in the figures, the skirt 12 delimits, in the inner face thereof, a flanged housing 36, which runs over the entire inner periphery of the skirt 12 and which is designed to receive the upper outer portion of the strip 22, in particular the tongues 32 of that strip, as shown in FIGS. 3 to 6, 8 and 9. In a known manner, this housing 36 facilitates and reliabilizes the positioning of the tongues 32 relative to the bulge 6 of the container neck 2: in fact, when the stopper is placed around the container neck 2, the downward crossing of the bulge 6 by the main body 24 of the strip 22 is facilitated and guided by the radial outward engagement of the tongues 22 inside the housing 36, from which the tongues 32 tend to exit slightly, while being guided in their travel by shape cooperation between the housing 36 and the strip 22, by elastic return of that strip 22 once its main body 24 has been passed below the bulge 6 of the container neck 2.

Figure 7:
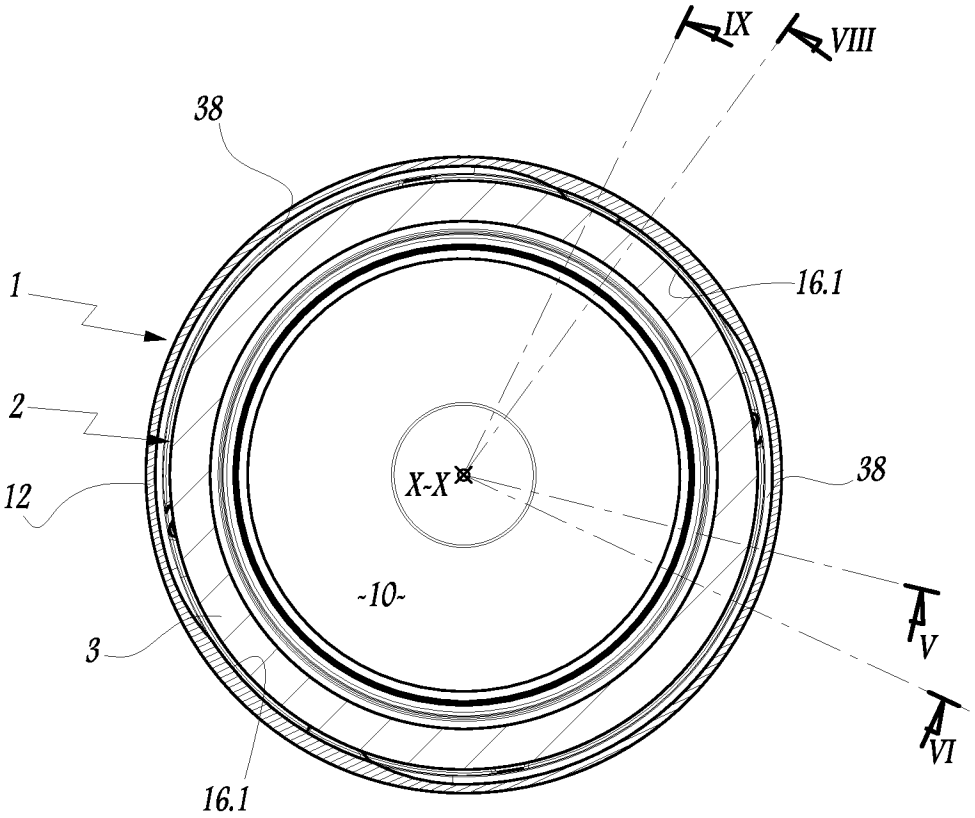
FIG. 7 is a cross-section along line VII-VII of FIG. 5, said FIG. 7 including lines V and VI respectively corresponding to the planes of the half-sections of FIGS. 5 and 6.

According to the advantageous arrangement described above, the flanged upper end of the housing 36 is beveled, as shown in FIGS. 3 to 7. More specifically, in the embodiment considered in the figures, the housing 36 has two bevels 38 at the upper end thereof, which each run over only a peripheral portion of the inner face of the skirt 12, while being diametrically opposite one another, as shown in FIG. 7. The two bevels 38 are separated from one another, along the inner periphery of the skirt 12, by the lower end 16.1 of the thread 16, more specifically by the respective lower ends of the threads making up the double thread 16. Of course, as an alternative not shown, the upper end of the housing 36 can be beveled over the entire inner periphery of the skirt 12, as long as the lower end 16.1 of the thread 16 is axially moved away upward, which, all other things being equal, causes a larger total axial dimension of the stopper than that of the stopper 1 considered in the figures.

Before further describing the cleaning of the container neck 2, below we will outline an example of manufacturing the stopper 1. The stopper 1 is advantageously manufactured by molding a semi-rigid plastic, such as polypropylene or polyethylene. This molding is provided to form, in a single piece and at the same time, the bottom wall 10; the skirt 12, in particular with its thread 16, its ribs 18 and its housing 36; and the strip 22 with its main body 24, with its through holes 26, its free surfaces 28 and its recesses 30, and its tongues 32. In practice, to that end, one uses a punch and a mold block delimiting an inner mold cavity in which the aforementioned punch is placed during the plastic injection operations. To mold the through holes 26, ad hoc drawers are for example arranged between the punch and the aforementioned mold block.

Advantageously, to facilitate stripping of the stopper 1, the strip 22 is molded with its free end, i.e., the end where the tongues 32 are provided, oriented downward: after stripping, the strip 22 is folded upward relative to the lower skirt portion 12.2, by deformation of the material connection between the end 24.1 of its main body 24 and the skirt portion 12.2, generally like a single-piece hinge connection. At the end of this folding movement, the strip 22 is in the configuration shown in FIGS. 1 to 4, i.e., in a usage configuration, in that the strip 22 is, with the rest of the stopper, ready to be placed around the container neck 2, with the understanding that, before or after having thus folded the strip 22 into its usage configuration, the skirt 12 is, upon leaving the mold, cut over the entire periphery thereof so as to form the weakening line 20. This being done, alternatively, rather than obtaining the weakening line 20 solely by cutting the skirt 12, this line may be partially or completely made during the molding of the stopper 1, in particular in the form of molded breakable bridges. Advantageously, it will be noted that the presence of through holes 26 is additionally interesting in that it facilitates said upward folding operation of the strip 22.

The assembly of the stopper 1 around the neck 2 then consists of attaching that stopper on the neck, by slipping around the neck, in particular by screwing, such that on the one hand, the free surfaces 28 pass axially below the bulge 6 while the tongues 32 are located radially inserted between said bulge 6 and the skirt 12, and on the other hand, the bottom wall 10 is axially pressed against the mouth 4, as shown in FIGS. 5 to 9.

Figure 5:
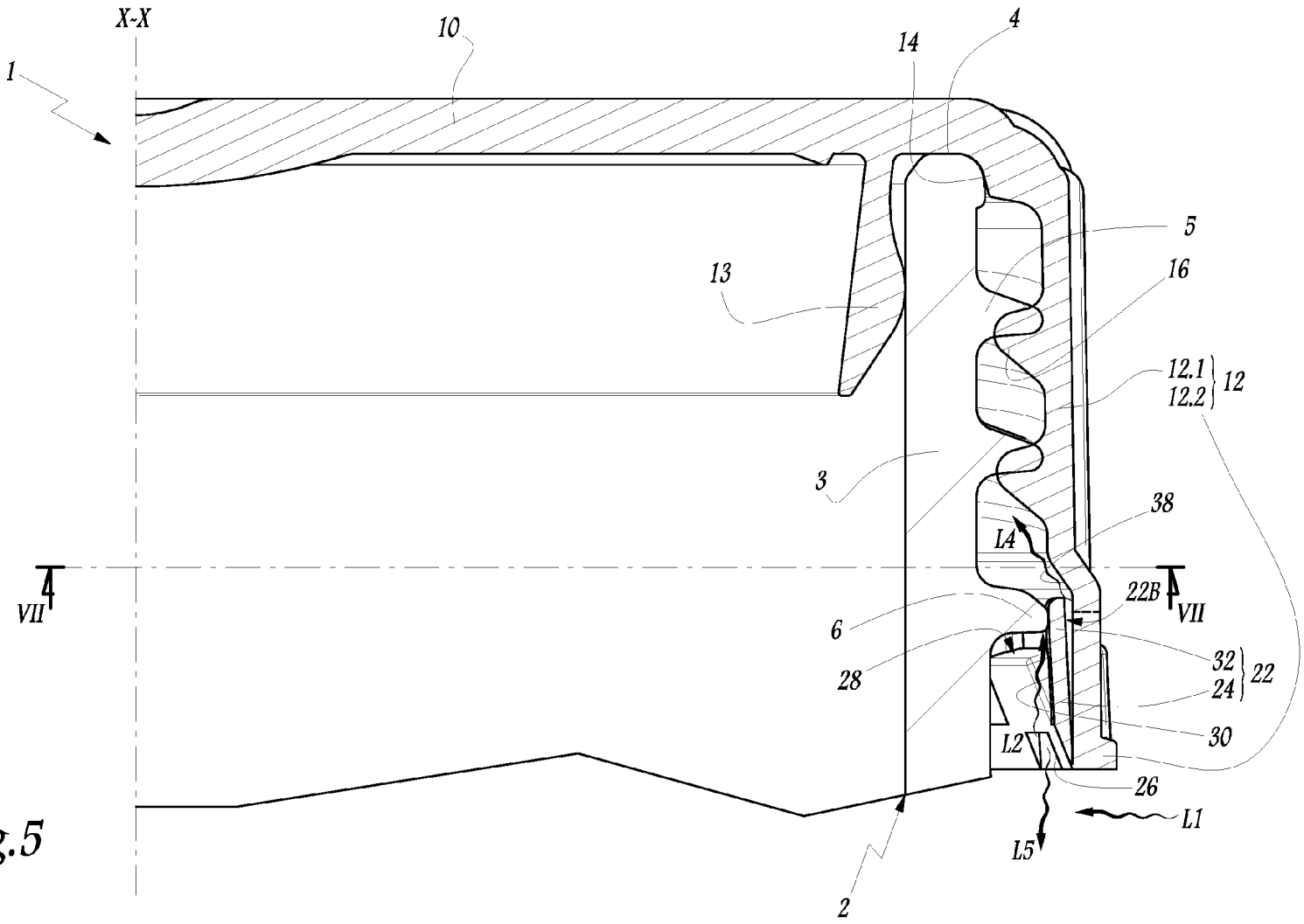
FIGS. 5 and 6 are half-sections respectively similar to FIGS. 5 and 6, showing the stopper, not yet open, in position on a container neck.
Figure 6:
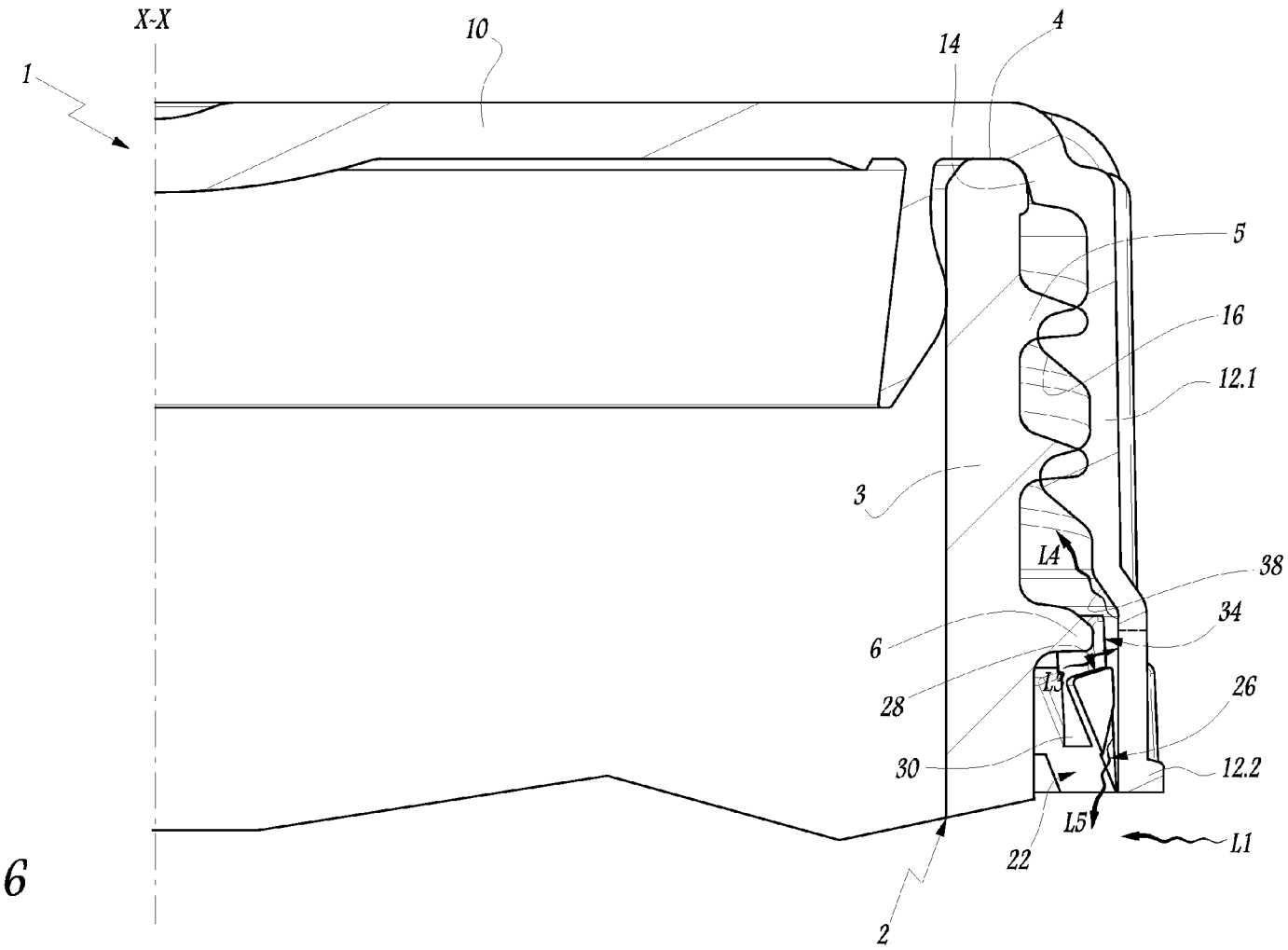
Figure 8:
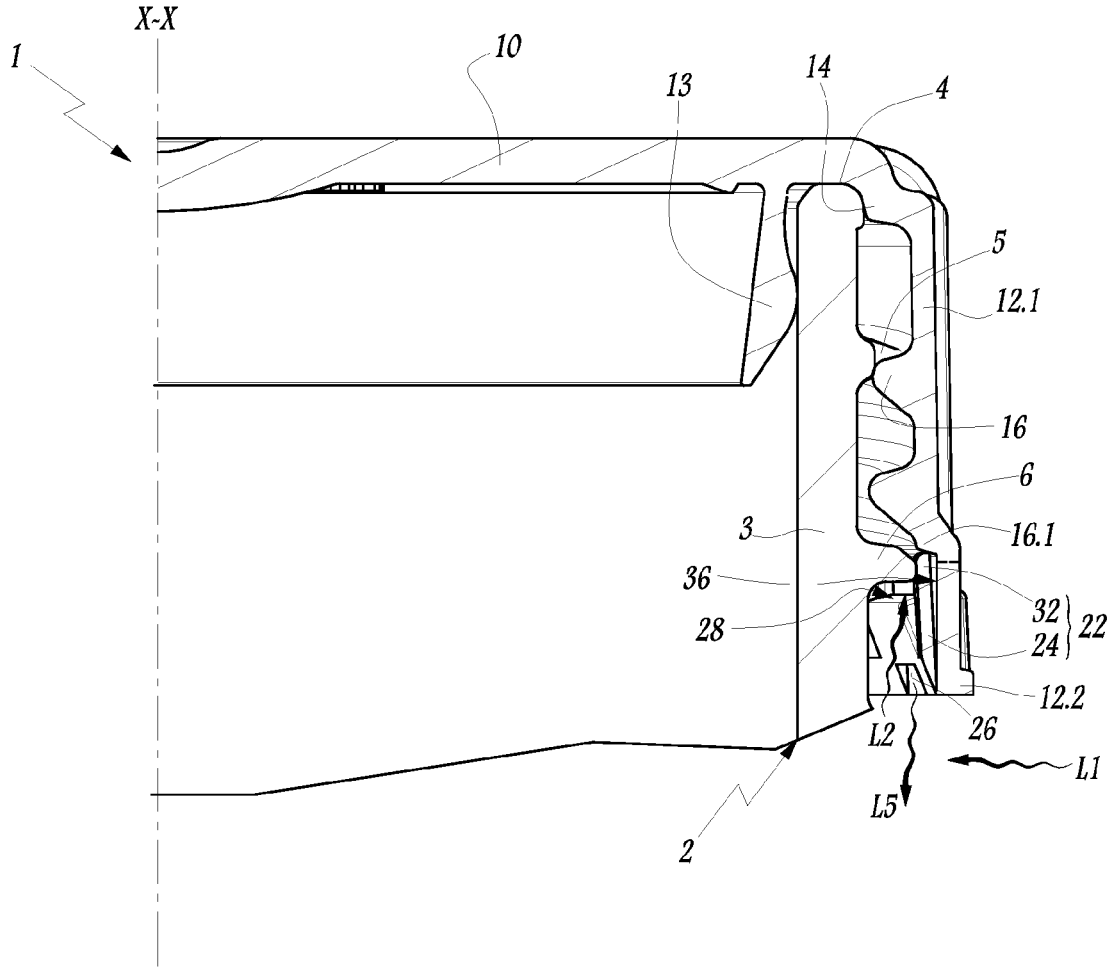
FIGS. 8 and 9 are longitudinal half-sections of the stopper and the container neck, respectively along lines VIII and IX of FIG. 7.

Once the stopper 1 is thus positioned around the neck 2, a pressurized cleaning liquid, in particular an aseptic solution, is sent from the outside of the skirt 12 toward the inside of the strip 22, as indicated by the arrow L1 in FIGS. 5, 6, 8 and 9. As shown in FIGS. 5 and 8 by the arrow L2, a significant quantity of liquid is then allowed into the recesses 30 and thus circulates through those recesses from the lower end 24.1 of the main body 24 of the strip 22 to the free surfaces 28, rising axially upward. Then, as indicated by the arrow L3 in FIGS. 6 and 9, the cleaning liquid, having reached the free surfaces 28 and spread all around the axis X-X, in particular by means of the axial play remaining between said surfaces 28 and the lower face of the bulge 6 of the neck of the container 2, circulates, through the free spaces 34, from the surfaces 28 to the outer face 22B of the strip 22, thereby reaching the upper region of the housing 36. Then, as indicated by the arrow L4 in FIGS. 5 and 6, this cleaning liquid circulates, axially upward along the bevels 38, from the outer face 22B of the strip 22 to the thread 16, while rising, under the effect of the pressure with which that liquid is sent from the outside of the skirt, around the body 3 of the container neck 2. The outer face of the body 3, in particular its thread 5 and its bulge 6, is thus swept and therefore cleaned by that liquid.

Figure 9:
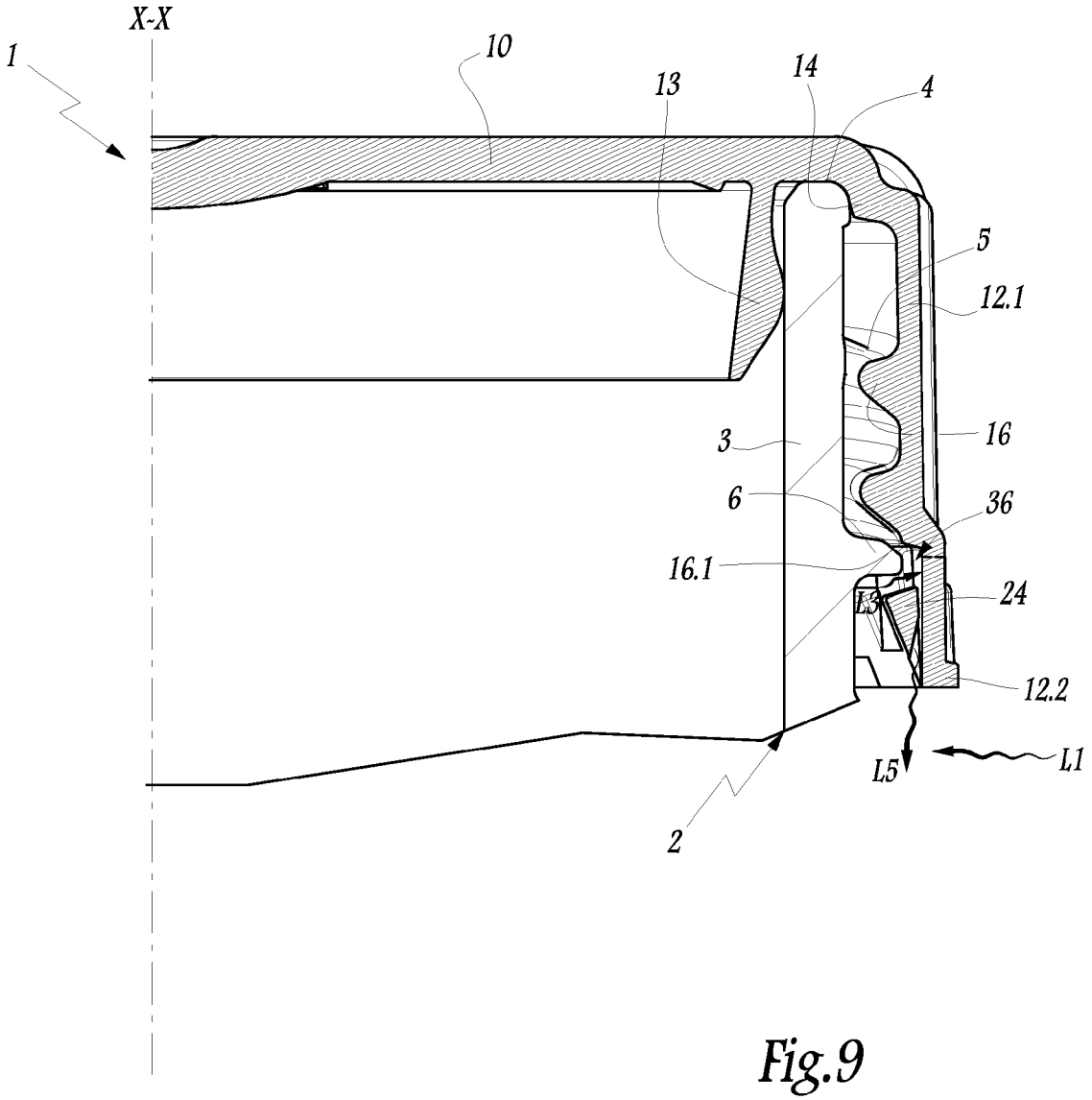

It will be noted that, along the inner periphery of the skirt, at the lower end 16.1 of the skirt 16, the latter parts prevent most or all of the cleaning liquid from rising axially upward beyond the housing 36, as will be understood in light of FIGS. 7 to 9. This local barricade to the rise of the cleaning liquid is offset by the bevels 38, in that, along the latter, a significant quantity of liquid can rise and thus sufficiently supply the free volume between the skirt 12 and the body 3 of the container neck 2, which makes it possible to clean the body over the entire outer periphery thereof.

Concomitantly, as well as after stopping the sending of pressurized cleaning liquid, the liquid located between the skirt 12 and the body 3 of the container neck 2 then streams downward, by gravity, along said body 3, until it reaches the strip 22. Part of the cleaning liquid can be discharged to the outside of the skirt 12 following a circulation opposite that described above relative to the arrows L2, L3 and L4. The rest of said cleaning liquid is discharged to the outside of the skirt 12, as indicated by the arrow L5, by flowing downward successively along the outer face 32B of the tongues 32 and along the outer face 24B of the main body 24, until it reaches the lower end 24.1 of said main body, from where the cleaning liquid escapes by passing through the holes 26. Of course, it will be understood that, as long as pressurized cleaning liquid is sent to the base of the stopper 1, the majority of the discharge of that liquid to the outside of the stopper is done by means of the holes 26.

Various developments and alternatives of the stopper 1 and its manufacturing method may also be considered. As examples:

embodiments other than the thread 16 may be considered regarding the removable fastening of the skirt portion 12.1 to the container neck 2; for example, the skirt portion 12.1 may be inwardly provided with one or more clips, provided to stick with a protruding outer edge of the container neck;

the stopper 1 may be incorporated into a stopper assembly with several components; an overcap may in particular cover part of the stopper 1, or a sealing washer may be attached against the inner face of the bottom wall 10; and/or the non-removable skirt portion 12.2 may be extended downward relative to its example embodiment illustrated in the figures, i.e., it may extend substantially below the strip 22, so as to better trim the lower portion of the body 3 of the container neck 2, without, however, harming the usage performance of the stopper and cleaning performance of the container neck.

The invention claimed is:

1. A stopper for a container neck, comprising:

a generally tubular skirt designed to surround the container neck, and provided with a peripheral weakening line adapted to be broken when the stopper is opened for the first time, the skirt including, on either side of the weakening line, along an axis of the skirt:

a removable skirt portion inwardly provided with fasteners for fastening the removable skirt portion to the container neck, and a non-removable skirt portion inwardly provided with a retaining strip for retaining the non-removable skirt portion around the container neck, the retaining strip including a main body which is generally annular and which, in a usage configuration of the retaining strip, is substantially centered on the axis of the skirt, wherein the main body includes:

a first axial end, which is opposite the removable skirt portion and which is secured to the non-removable skirt portion, and a second axial end, opposite the first axial end of the main body, the second axial end being configured to:

in the inner radial portion of the second axial end, delimit axial abutment surfaces against which an associated bulge of the container neck is intended to abut to retain the non-removable skirt portion around the container neck when the stopper is opened for the first time, the abutment surfaces being distributed along an inner periphery of the main body of the retaining strip, and in the outer radial portion of the second axial end, bear protruding tongues which are intended to be radially inserted between the bulge and the skirt, the tongues being distributed along an outer periphery of the main body, while being separated by one or more openings configured to receive a cleaning liquid for cleaning the container neck which circulates between the abutment surfaces and the outer face of the retaining strip, wherein the abutment surfaces are separated by one or more recesses, that are formed in the inner face of the main body of the retaining strip, without emerging transversely in an outer face of the main body, the recesses being configured to receive a cleaning liquid for cleaning the container neck which circulates between the first end of the main body and the abutment surfaces.

2. The stopper according to claim 1, wherein the inner surface of the skirt has a flanged housing for receiving the tongues, the housing having, at an axial end facing the fasteners, at least one bevel that runs over at least one peripheral portion of the inner face of the skirt and configured to receive a cleaning liquid for cleaning the container neck that circulates between the outer surface of the retaining strip and the fasteners.

3. The stopper according to claim 2, further comprising a plurality of bevels, which are distributed along the inner periphery of the skirt, while being separated by one or more parts of the fasteners.

4. The stopper according to claim 1, wherein the recesses occupy respective angular positions around the axis that are substantially the same as those occupied by the tongues.

5. The stopper according to claim 4, wherein the abutment surfaces occupy respective angular positions around the axis that are substantially the same as those occupied by the openings.

6. The stopper according to claim 5, wherein the recesses have a peripheral dimension around the axis that is substantially equal to that of the tongues, and the abutment surfaces have a peripheral dimension that is substantially equal to that of the openings.

7. The stopper according to claim 4, wherein the inner face of each tongue extends flush with the radial bottom of the recesses.

8. The stopper according to claim 1, wherein the first end of the main body of the retaining strip is provided with at least one through hole configured to discharge a cleaning liquid for cleaning the container neck, which connects one from among the inner and outer faces of the main body to the other.

9. The stopper according to claim 8, further including a plurality of discharge holes, which are distributed along the periphery of the main body, occupying respective angular positions around the axis that are substantially the same as those occupied by the abutment surfaces.

10. The stopper according to claim 1, wherein, by folding the first end of the main body, the retaining strip can be folded down relative to the rest of the non-removable skirt portion, to go from a manufacturing configuration of the stopper, in which the second end of the main body is turned opposite the removable skirt portion, to the usage configuration.

* * * * *